US007275768B2

(12) United States Patent
Martin et al.

(10) Patent No.: US 7,275,768 B2
(45) Date of Patent: Oct. 2, 2007

(54) HAND STRAP ENTRY DEVICE

(76) Inventors: Dennis V. Martin, 28 Cambridge Dr., Hershey, PA (US) 17033; Charles R. Fisher, 255 Elm Ave., Hershey, PA (US) 17033

( * ) Notice: Subject to any disclaimer, the term of this patent is extended or adjusted under 35 U.S.C. 154(b) by 0 days.

(21) Appl. No.: 10/770,154

(22) Filed: Feb. 2, 2004

(65) Prior Publication Data

US 2004/0178621 A1 Sep. 16, 2004

Related U.S. Application Data

(60) Provisional application No. 60/455,947, filed on Mar. 19, 2003, provisional application No. 60/452,995, filed on Mar. 11, 2003.

(51) Int. Cl.
*A63C 11/00* (2006.01)

(52) U.S. Cl. ..... 280/819; 280/821

(58) Field of Classification Search ..... 280/819, 280/821, 814, 822, 816, 820; 24/71 SK, 24/68 SK, 68 R; 224/264, 665, 250, 577; 2/159, 209.13; 16/114.1, 419, 428
See application file for complete search history.

(56) References Cited

U.S. PATENT DOCUMENTS

| | | | | |
|---|---|---|---|---|
| 216,027 | A | 6/1879 | Dippert | |
| 498,221 | A | 5/1893 | Allen | |
| 980,421 | A * | 1/1911 | Jordan | 224/264 |
| 1,204,891 | A * | 11/1916 | Lotz | 16/114.1 |
| 1,359,461 | A * | 11/1920 | Luce | 16/411 |
| 1,500,029 | A * | 7/1924 | Oliver | 16/114.1 |
| 2,287,329 | A * | 6/1942 | Santa Maria et al. | 16/428 |
| 2,608,326 | A * | 8/1952 | Spector | 224/264 |
| 3,230,009 | A | 1/1966 | Schmidt et al. | 297/388 |
| 3,433,495 | A * | 3/1969 | Christensen | 280/821 |
| 3,545,784 | A * | 12/1970 | Alsop | 280/821 |
| 3,808,645 | A * | 5/1974 | Chow | 24/71 SK |
| 3,825,276 | A * | 7/1974 | Adelmann | 280/821 |
| 3,923,317 | A * | 12/1975 | Penney | 280/821 |
| 4,775,168 | A * | 10/1988 | Dalebout | 280/821 |
| 4,887,318 | A * | 12/1989 | Weinreb | 2/268 |
| 4,962,873 | A * | 10/1990 | Schattel | 224/665 |
| D327,846 | S * | 7/1992 | Jacobs | D9/434 |
| 5,165,584 | A * | 11/1992 | Meagher et al. | 224/258 |
| 5,318,209 | A * | 6/1994 | Rader et al. | 224/250 |
| 5,357,655 | A * | 10/1994 | Hayward | 24/68 R |

(Continued)

FOREIGN PATENT DOCUMENTS

DE 3941171 A * 6/1991

OTHER PUBLICATIONS

Kwik Strap, Inc., Product Detail, http://www.orderdepot.com/templates/product.asp?ID=3053800002, Sep. 18, 2003, 2 pages.

(Continued)

*Primary Examiner*—Hau Phan
(74) *Attorney, Agent, or Firm*—Woodcock Washburn LLP

(57) ABSTRACT

A ski pole strap entry device including a base member having a first side and an opposing second side, and a retainer disposed on the base member for engaging a portion of a ski pole strap. The first side includes an arcuate-shaped surface that is sized and configured to receive a portion of a user's hand, wrist, or both.

8 Claims, 2 Drawing Sheets

U.S. PATENT DOCUMENTS

| | | | | |
|---|---|---|---|---|
| 5,441,184 | A * | 8/1995 | Durso | 224/577 |
| 5,733,004 | A | 3/1998 | Celestina-Krevh et al. | 297/250.1 |
| 5,887,282 | A * | 3/1999 | Lenhart | 2/159 |
| 5,908,206 | A * | 6/1999 | LoPresti, Jr. | 280/814 |
| 6,135,852 | A * | 10/2000 | Young | 2/268 |
| 6,256,847 | B1 * | 7/2001 | Manley et al. | 24/593.11 |
| 6,279,168 | B1 * | 8/2001 | Bean | 2/209.13 |
| 6,338,180 | B1 * | 1/2002 | Massard | 16/114.1 |
| 6,385,819 | B1 * | 5/2002 | Ingold | 280/821 |
| 6,386,588 | B1 | 5/2002 | Young et al. | 280/821 |
| 6,502,862 | B1 * | 1/2003 | Lenhart | 280/821 |
| 6,536,078 | B2 * | 3/2003 | Tsai | 16/114.1 |
| 6,859,945 | B1 * | 3/2005 | Crawford | 2/336 |

OTHER PUBLICATIONS

Product Brochure- Kwik Strap™, Kwik Strap, Ski Hassle Free, Don't Ski Strapless, www.kwikstrap.com, 4 pages.

* cited by examiner

HAND STRAP ENTRY DEVICE

CROSS REFERENCE TO RELATED APPLICATIONS

This application claims the benefit of U.S. provisional application Ser. No. 60/452,995 filed Mar. 11, 2003, and U.S. provisional application Ser. No. 60/455,947 filed Mar. 19, 2003.

FIELD OF THE INVENTION

The present invention relates to a ski pole strap entry device. The device is designed and configured to engage a ski pole strap, and to spread or hold open opposing portions of the engaged strap.

BACKGROUND OF THE INVENTION

Ski poles are typically fitted with one or more straps that hang downward in a looped configuration. A skier ordinarily will insert and remove his hands from a ski pole strap numerous times during a ski session. Since ski pole straps are commonly made from flexible materials, major opposing portions tend to collapse together such that only a narrow opening exists for inserting a skier's hand. The narrow opening can interfere with the convenient and safe insertion and withdrawal of the skier's hand.

Attempts to design a device to simply and effectively maintain separation of opposing strap portions have been made with limited success. Examples of such devices are disclosed in U.S. Pat. No. 3,433,495 and U.S. Pat. No. 6,385,819. Ingold, in the later patent, discloses a device that includes a flexible base having a generally flat configuration when unattached to a ski strap. The material of the device is selected to have the flexibility to bend in conformance to the contour of the ski strap, but possess a greater rigidity than the material of the strap.

The present invention provides a device with improvements over the above-mentioned prior art through one or more of the features described hereinbelow.

SUMMARY OF THE INVENTION

The present invention is directed to devices for separating opposed portions of ski pole strap to provide a sufficient opening for inserting and removing a skier's hand. In accordance with one preferred embodiment of the present invention, there has now been provided a ski pole strap entry device including a base member having a first side, an opposing second side, and a retainer disposed thereon for engaging a portion of a ski pole strap. The base member first side includes a surface that is arcuate-shaped in its natural state. The arcuate-shaped surface is sized and configured to receive a portion of a user's hand, wrist, or both.

In accordance with another preferred embodiment, there has now been provided a ski pole strap entry device including a curve-formed base member and a retainer disposed on the base member for engaging a portion of a ski pole strap. The curve-formed base member has a radius of from about 2 inches to about 6 inches.

In accordance with another preferred embodiment, there has now been provided a ski pole strap entry device including a base member and a retainer disposed on the base member. The base member has an arcuate-shaped configuration at least upon engagement with a ski pole strap, which includes a radius of from about 2 inches to about 6 inches. The retainer requires no manipulation for securing a ski pole strap to the base member.

In accordance with yet another preferred embodiment, there has now been provided a ski pole strap entry device including a flexible base member having an arcuate-shaped engagement configuration with a ski pole strap, a plurality of apertures formed in the base member, and a plurality of tabs, each of which overhang at least a portion of the one of the apertures.

The present invention is also directed to ski poles employing ski pole strap entry devices. In accordance with one embodiment, there has now been provided a skip pole including a ski pole strap extending from an end of the pole, and an entry device affixed to the ski pole strap. The entry device includes a base member having a first side, an opposing second side, and a retainer disposed thereon for engaging a portion of the ski pole strap. The base member first side includes an arcuate-shaped surface that is sized and configured to receive a portion of a user's hand, wrist, or both.

These and various other features of novelty, and their respective advantages, are pointed out with particularity in the claims annexed hereto and forming a part hereof. However, for a better understanding of aspects of the invention, reference should be made to the drawings which form a further part hereof, and to the accompanying descriptive matter, in which there is illustrated preferred embodiments.

BRIEF DESCRIPTION OF THE DRAWINGS

The present invention is believed to be best understood through the following detailed description of the preferred embodiments and the accompanying drawings wherein like reference numerals indicate like features, and wherein.

DETAILED DESCRIPTION OF ILLUSTRATIVE EMBODIMENTS

Figure 1:
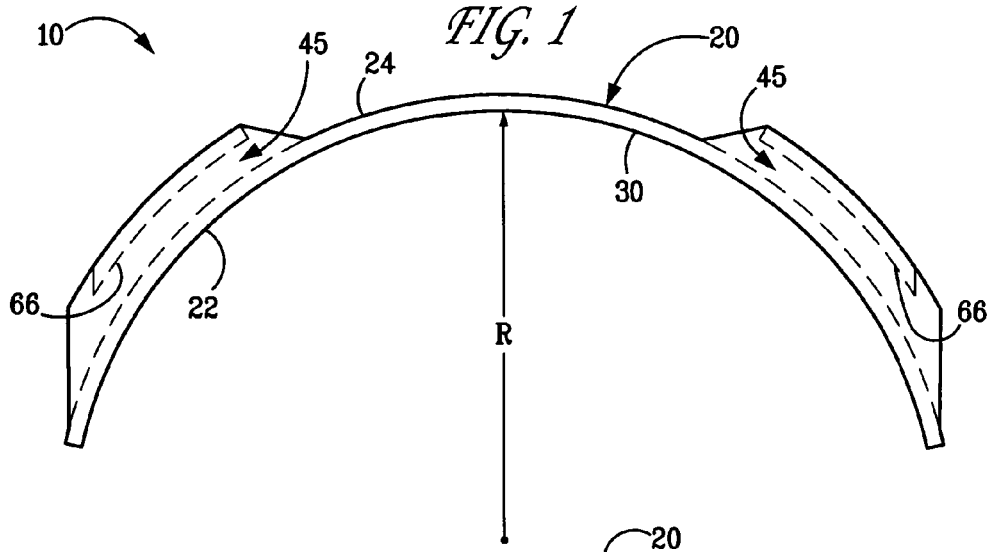
FIG. 1 is a side view of one preferred ski pole entry device embodiment provided by the present invention, the device includes a first and a second pair of facing L-brackets disposed on a curve-formed base member.
Figure 2:
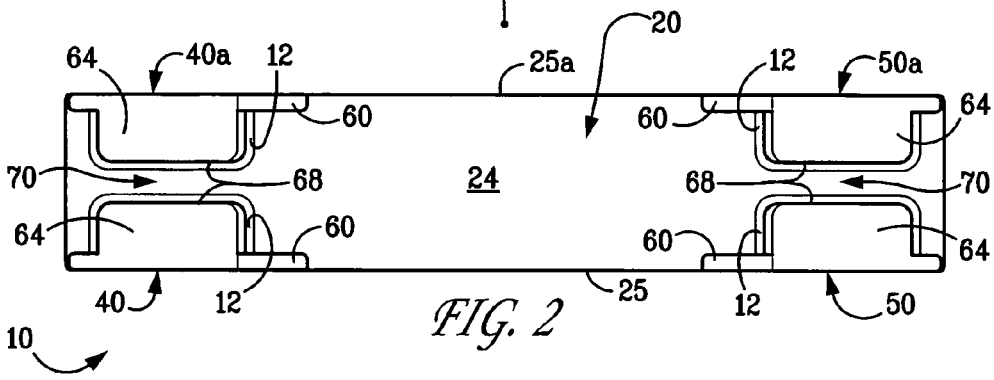
FIG. 2 is a plan view of one side of the device shown in FIG. 1.
Figure 3:
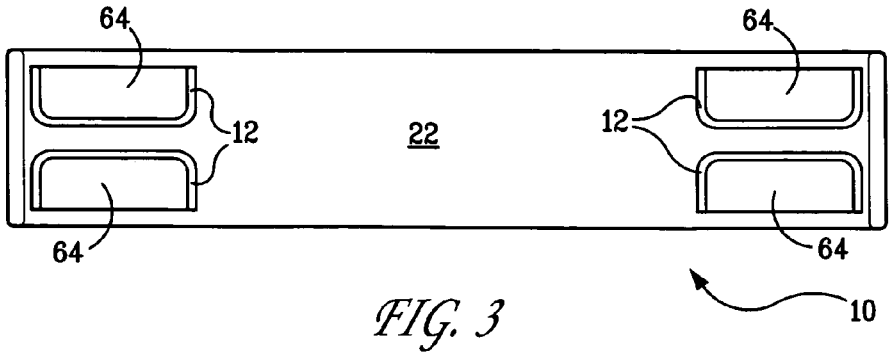
FIG. 3 is a plan view of the opposing side of the device shown in FIG. 1.

Referring to FIGS. 1-3, a ski pole strap entry device 10 is shown including a base member 20 having a first side 22 and an opposing second side 24. In a preferred embodiment, base member 20 is curve-formed, such that device 10 has an arcuate-shaped configuration in its natural state (i.e., in the absence of any applied force), including an arcuate-shaped surface 30 defined on first side 22. As used herein, "curve-formed" means manufactured in a non-planar form. In an alternative embodiment, the device base member has an arcuate-shaped surface on one of its sides, but not on the opposing side. The arcuate-shaped configuration of base member 20 (or just one of its surfaces, such as, for example, surface 30) has a radius R that is preferably from about 2 inches to about 6 inches, and more preferably from about 2.5 inches to about 3.5 inches. Device 10 receives a portion of a skier's hand and/or wrist with the preferred arcuate-shaped configuration. This feature not only provides a proper opening in a looped ski pole strap for inserting one's hand, but it may also provide vibration absorption or force distribution when in use.

Device 10 further includes a retainer for engaging a portion of a ski pole strap. In one preferred embodiment, the retainer comprises a first pair of opposing L-brackets 40, 40*a* and a second pair of opposing L-brackets 50, 50*a* that are spaced apart from L-brackets 40, 40*a*. Each of the L-brackets are defined by a rail 60 extending from a longitudinal edge 25, 25*a* of the second side 24 of base member 20, and a tab 64 extending inwardly from rail 60. A strap receiving-space 45 is defined between an inner surface 66 of the tabs and the base member. A slot 70 exists between respective distal ends 68 of facing tabs 64. Slot 70 provides a pathway for inserting a ski pole strap into strap receiving space 45. The number of L-brackets may be greater or fewer than that shown. Furthermore, although the L-brackets are shown in a common orthogonal form, rails and tabs may collectively have a curvilinear form to define, for example, a J-shape or C-shape extension from the longitudinal edges of the base member.

Figure 6:
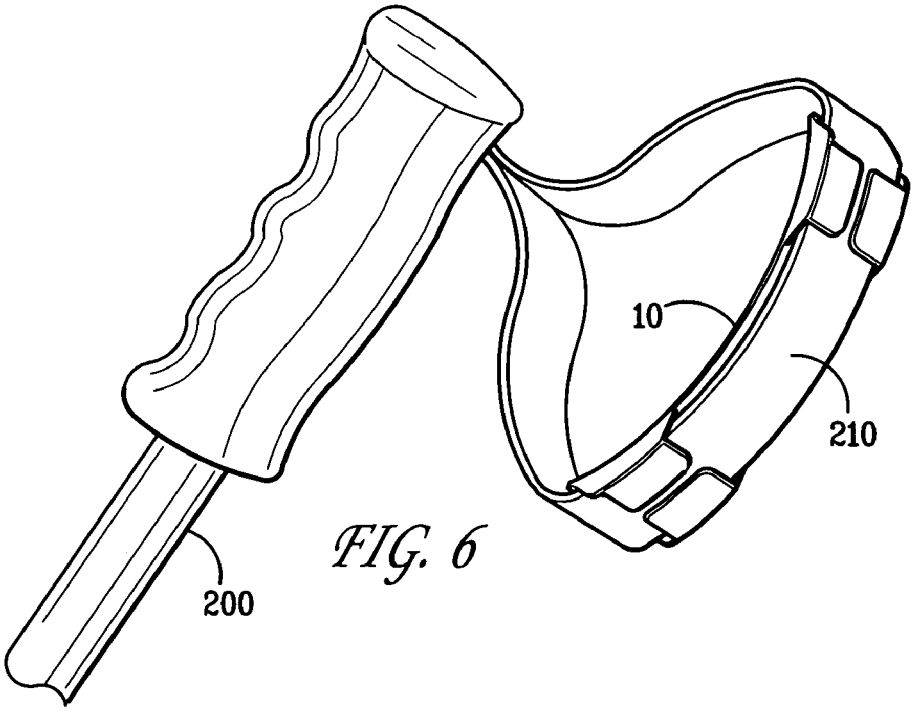
FIG. 6 is a perspective view of a ski pole including a strap extending from its handle end and a preferred entry device in accordance with the present invention coupled to the strap.

To engage a ski pole strap, a user can fold a portion of the strap widthwise in half to form a loop with two edges. The two edges are inserted into slot 70, and then the user applies pressure on the loop to force the edges apart such that the strap flattens and resides within strap receiving space 45. In this manner, the retainer itself requires no manipulation for engaging a ski pole strap. Additional strap engagement techniques can equally be used with devices of the present invention. For example, the user can insert one edge of the ski pole strap underneath one tab 64 and then manipulate the opposing strap edge to reside underneath a facing tab 64. FIG. 6 illustrates a typical ski pole 200 having a strap 210 extending from its handle end with entry device 10 affixed to a portion of the strap.

Figure 4:
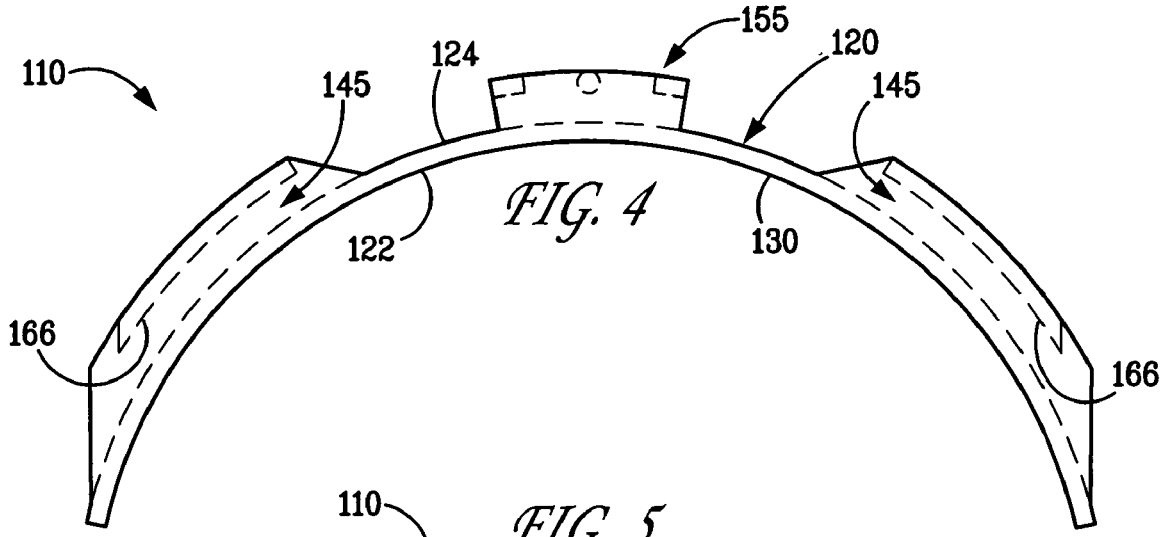
FIG. 4 is a side view of another preferred ski pole entry device embodiment provided by the present invention, the device including an arcuate-shaped base member having a buckle centrally disposed between two pairs of L-brackets for securely fastening ends of a ski pole strap to the base member.
Figure 5:
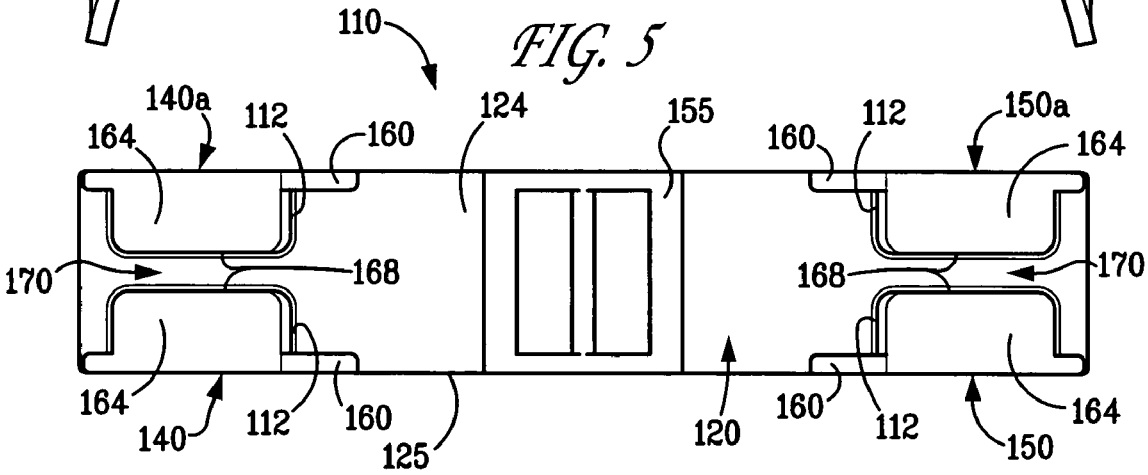
FIG. 5 is a plan view of one side of the device shown in FIG. 4.

Referring now to FIGS. 4 and 5, another preferred ski pole entry device embodiment 110 is shown. Features that are similar to those employed by device 10 have similar reference numerals in the hundred series, although not specifically discussed. The retainer of device 110 includes a buckle 155 interposed between a first pair of L-brackets 140, 140*a* and second pair of L-brackets 150, 150*a*. Many ski pole straps have a buckle for adjusting the length of the strap. Device 110 eliminates the need for a separate buckle. Ski pole straps already having a buckle can be affixed to a device such as that shown in FIG. 1, with the buckle positioned between the first and second pairs of L-brackets. It should be noted, that devices contemplated by the present invention may employ retainers defined only by a buckle (that is, without L-brackets).

Some preferred devices of the present invention include apertures formed in their base members. Referring again to FIG. 2, base member 20 of device 10 includes four apertures 12 extending from first side 22 to second side 24. Preferably, and as shown in FIG. 2, individual tabs 64 overhang at least a portion of each of apertures 12. In such an arrangement, rail sections 60 extend at least coterminously alongside apertures 12, and preferably extend alongside and beyond the apertures.

Base members and retainers of the present invention are preferably injection molded using a material comprising a thermoplastic. One preferred material comprises a thermoplastic rubber, such as, for example, Pellathane. Additional preferred materials includes polyethylene's, polypropylene's, and blends of the same. Rubber materials and low molecular weight polyolefin's may help to dampen or absorb vibrations, as well as enhance the distribution of stress associated with pole planting during skiing. Base members and retainers in accordance with the present invention may also be die-stamped from a sheet of suitable material and then formed into various configurations. The retainer features described above are preferably integrally formed with the base member. However, the retainer features may be formed separately and thereafter coupled to the base member.

Although all of the device base members shown in the figures are manufactured to have an arcuate-shaped configuration without any applied force, base members of the present invention may also have a substantially planar arrangement prior to engaging a strap. Upon engagement, the planar base member deforms or flexes into an arcuate-shaped configuration with sufficient hoop stress arising from collapsing ski strap portions.

It is to be understood that even though numerous characteristics and advantages of the present invention have been set forth in the foregoing description, together with details of the structure and function of the invention, the disclosure is illustrative only. Accordingly, changes may be made in detail, especially in matters of shape, size and arrangement of features within the principles of the invention to the full extent indicated by the broad general meaning of the terms in which the appended claims are expressed.

What is claimed:

1. A ski pole strap entry device, comprising:

a base member that is arcuate-shaped in its natural state, the base member being sized and configured to receive a portion of a user's hand, wrist, or both; and a retainer disposed on a side of the base member for engaging a portion of a ski pole strap;

wherein, when said ski pole strap is engaged in said retainer, said ski pole strap forms a loop adjacent a ski pole handle of a ski pole for receiving said user's hand, wrist, or both, wherein the retainer includes a first L-bracket extending from a longitudinal edge of the base member second side and a second L-bracket extending from an opposing longitudinal edge of the base member second side, and wherein distal ends of the first and second L-brackets are directed towards one another.

2. The device of claim 1, wherein the arcuate-shaped surface comprises a radius of from about 2 inches to about 6 inches.

3. The device of claim 1, wherein the arcuate-shaped surface comprises a radius of from about 2.5 inches to about 3.5 inches.

4. The device of claim 1, wherein a slot is defined between the distal ends of the first and second L-brackets, the slot providing a pathway for inserting a ski pole strap underneath the first and second L-brackets.

5. The device of claim 1, wherein the retainer further includes a buckle disposed on the base member second side, the buckle being spaced apart from the first and second L-brackets.

6. The device of claim 1, wherein the retainer comprises a buckle disposed on the base member second side for receiving one or more ends of a ski pole strap.

7. The device of claim 1, wherein the base member comprises at least one aperture extending from the first side to the opposing second side.

8. The device of claim 1, wherein the retainer requires no manipulation for securing a ski pole strap to the base member.

* * * * *